US008333252B2

(12) United States Patent
Britz et al.

(10) Patent No.: US 8,333,252 B2
(45) Date of Patent: Dec. 18, 2012

(54) HAND-HELD POWER TOOL WITH GROUNDING

(75) Inventors: Rory Britz, Shanghai (CN); Rainer Ontl, Landsberg am Lech (DE); Thomas Hofbrucker, Mammendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 1036 days.

(21) Appl. No.: 11/708,087

(22) Filed: Feb. 15, 2007

(65) Prior Publication Data

US 2007/0221392 A1 Sep. 27, 2007

(30) Foreign Application Priority Data

Feb. 20, 2006 (DE) ..... 10 2006 000 084

(51) Int. Cl.
*E21B 19/16* (2006.01)

(52) U.S. Cl. ..... 173/217; 173/170; 173/171; 310/50

(58) Field of Classification Search ..... 173/170, 173/171, 217; 310/50; 53/133.3
See application file for complete search history.

(56) References Cited

U.S. PATENT DOCUMENTS

| | | | | |
|---|---|---|---|---|
| 1,754,222 | A * | 4/1930 | Connell | 173/217 |
| 2,237,646 | A * | 4/1941 | Wilhide | 310/68 A |
| 5,997,177 | A * | 12/1999 | Kaufman | 383/5 |
| 6,043,575 | A * | 3/2000 | Ghode et al. | 310/52 |
| 7,308,950 | B2 * | 12/2007 | Faatz et al. | 173/217 |
| 2004/0263008 | A1 * | 12/2004 | Voigt et al. | 310/58 |
| 2005/0230134 | A1 * | 10/2005 | Wu | 173/217 |
| 2006/0000627 | A1 * | 1/2006 | Frauhammer et al. | 173/201 |

* cited by examiner

*Primary Examiner* — Brian D Nash
*Assistant Examiner* — Michelle Lopez
(74) *Attorney, Agent, or Firm* — Abelman, Frayne & Schwab

(57) ABSTRACT

An electrical hand-held power tool (2) includes a housing (4) in which a drive (6) is located, a ventilator (22) for forming a suction region (28) and a pressure region (30) in the housing (4) which provide for an air flow (L) that serves for cooling at least parts of the drive (6), and a separation element (26) arranged between the suction region (28) and the pressure region (30) and fixedly secured in the housing (4), the separation element (46) having an opening for forming a limited wire passage region (46) from the suction region (28) into the pressure region (30).

5 Claims, 3 Drawing Sheets

6
16
14
18
20
36
L
8
10
22
46
26
24
D
L
L
L

HAND-HELD POWER TOOL WITH GROUNDING

BACKGROUND OF THE INVENTION

1. Field of the Invention

The present invention relates to a hand-held power tool including a housing, a drive located in the housing and including a motor, a gear unit and, optionally, a percussion mechanism. The hand-held power tool further includes ventilation means for forming a suction region and a pressure region in the housing which provide for an air flow that serves for cooling at least parts of the drive, and a separation element arranged between the suction region and the pressure region and fixedly secured in the housing.

2. Description of the Prior Art

In the hand-held power tools of the type described above, a constructive separation of the overpressure region in which ventilation means produces a blowing flow, and of the suction region in which the ventilation means produces a suction flow, insures a relatively high cooling capacity.

German Publication DE 42 20 078 A1 discloses a hand-held power tool in which a radial ventilator is located in the tool housing. The ventilator is driven by a motor and aspirates axially cooling air and presses it radially outwardly through air outlet slots from the housing. For increasing pressure and raising the volumetric flow of the radial ventilator, an air conducting element is provided therein and which is held circumferentially in the housing with a concentric cover. The cover separates the pressure region form the suction region.

In some countries, e.g., in some parts of the U.S., electrical tools and, in particular, electrically driven by an electric motor, hand-held tools must be equipped with a protective ground wire which is connected electrically with a ground conductor of the network cable for protection of metallic parts located in the interior of the housing of the electrical hand-held tool. The related metallic parts can be formed, e.g., by housing parts of the gear unit, percussion mechanism, or stator or by bare contact elements for diverting leak currents.

German Patent No. 950,658 discloses an electrical hand-held power tool the motor of which is separated from metal parts of the housing by isolating plastic parts. In addition, in the interior of the tool housing, there is provided two bare annular electrodes which are connected by a protective ground wire to ground or zero point of the network. Further, in the tool housing, there is provided a ventilator wheel that produces, during an operation, a suction region and a pressure region. The protective ground wire is freely mounted in an open transition region between the suction and pressure regions.

The drawback of the known construction consists in that because of the open transition region between the suction and pressure zones, only a relatively weak air flow is produced. In addition, the protective ground wire has a relatively high freedom of movement that can lead to damages during the operation.

Accordingly, an object of the invention is to eliminate the above-mentioned drawbacks in the electrical hand-held power tools of the type discussed above.

Another object of the present invention is to provide an electrical hand-held power tool in which a maximal cooling efficiency is possible independent from requirements in respective countries or use-specific requirement with respect to ground conductors.

SUMMARY OF THE INVENTION

These and other objects of the present invention, which become apparent hereinafter, are achieved by providing a separation element having opening means for forming a wire passage region from the suction region in the pressure region and which is closed in the initial condition and can be optionally open.

In this way, the construction of a hand-held, electrically driven power tool can be adapted or not adapted to the use of a protective ground wire, dependent in which countries it is used or what requirements the hand-held power tool should meet.

If a protective ground wire is used, e.g., because of the corresponding requirement to the power tool in question in the country of use, the wire passage region can be open by a simple secondary treatment. This enables a short connection between the related metallic part and the ground conductor, on one hand, and a simple mounting and a reliable fixation of the protective ground wire. At that, the wire passage region is adapted to the cross-section of the protective wire in order to minimize a possible pressure or temperature imbalance and a resulting reduction in the cooling efficiency.

In case no protective ground wire is needed, the wire passage region remains closed to provide for as complete as possible separation of the suction and pressure regions and a resulting therefrom, maximal cooling efficiency.

Thereby, all of the power tools of a particular type can include both embodiments and be manufactured of the same housing components and, in case of a need in a prescribed additional protective ground wire, be modified by a simple aftertreatment. In both cases, a high cooling efficiency is insured.

According to a particularly advantageous embodiment, the separation element is formed by air conducting means located in the housing, with the wire passage region being formed at an edge of the separation element. Thereby, the separation element and the opening means that is provided therein, can be produced separately from a conventional housing and in a particular simple manner. In addition, in this case, the opening means is particularly easily accessible, which substantially simplifies the secondary treatment for forming the wire passage region.

Advantageously, the opening means provides that a predetermined region of the separation element is irreversibly deformed for forming the wire passage region. Thus, the predetermined region can, e.g., be plastically deformed or broken-through. In both cases, a lasting wire passage region is formed in which the protective ground wire can be easily mounted and reliably held.

Advantageously, the opening means is formed by break-through assist means, which enables a particularly simple and rapid formation of the wire passage region.

Preferably, the break-through assist means is formed by material weakening that, e.g., forms a braking line or a flat region with a reduced material strength in comparison with the remaining portion of the separation element. Thereby, the opening means can be formed in a particular simple way, e.g., by correspondingly shaping a casting of the separation element or by a subsequent embossing.

Preferably, the material weakening has a U-shaped delimitation extending to the edge of the separation element. This provides for an exact predetermined limitation of the break-through region and an easy breaking-through a region designed for forming the wire passage region with a suitable tool, e.g., flat nose pliers.

According to an alternative embodiment, the opening means provides for an elastical deformation of a predetermined region of the separation element for forming the wire passage region. E.g., the opening means can be formed by an elastic diaphragm provided on the separation element. The diaphragm is deformed during mounting of the protective ground wire by its cross-section, with the diaphragm applying pressure to the surface of the protective ground wire. In this way, the wire passage region is sealed particularly well during insertion of the wire.

It is advantageous when the opening means includes a film hinge that pivotally supports a predetermined region. The film hinge can be elastically or plastically deformed. In each case, the wire passage region can be formed without use of any tool, which substantially simplifies mounting of the protective ground wire.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
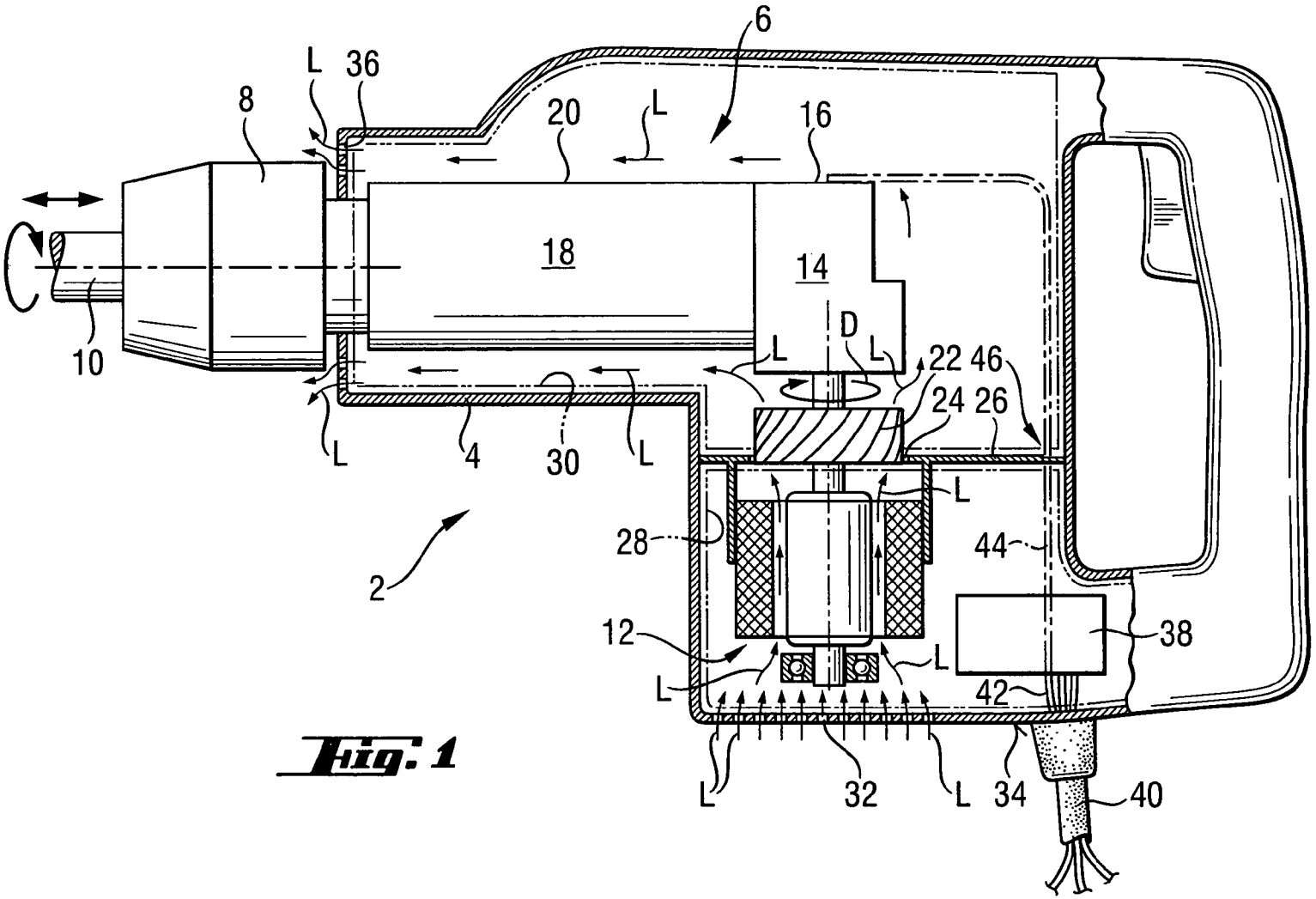
FIG. 1 a side partially cross-sectional view of a hand-held power tool according to the present invention.

A hand-held power tool 2 according to the present invention, which is shown in FIG. 1, has a housing 4 in which there is arranged a drive 6 for driving a working tool 10 receivable in a chuck 8. The drive 6 includes a motor 12, a gear unit 14 located in a gear unit housing 16, and a percussion mechanism 18 arranged in a percussion mechanism housing 20. Alternatively, there can be provided a hand-held power tool 2 without the percussion mechanism 18.

The motor 12 drives ventilation means 22 in form of a ventilator supported on a separation element 26, arranged on an opening 24 in the housing 4 and serving as air conducting means. The separation element 26 is form- or forcelockingly held on the housing 4, in a manner not shown in the drawing in detail, in the condition of the hand-held power tool 2 after the final assembly. Alternatively, the separation element can be formed as one-piece with a part of the housing 4. In each case, during rotation of the ventilation means 22 in the housing 4 in the direction shown with arrow D, a suction region 28 is formed on one side of the separation element 26 and a pressure region 30 is formed on another side of the separation element 26. Thereby, there is produced an air flows in the directions indicated with arrows L. The air enters the housing 4 through inlet openings 32 in a bottom 34, flows along the motor 12 for cooling the same, and then flows through the opening 24 out of the suction region 28 and into the pressure region 30 where it flows along the gear unit 14 and the percussion mechanism 18 for cooling them. The air flows out of the pressure region through outlet openings 36 in the direction of the chuck 8.

For its power supply, the motor 12 is connected, in a manner not shown in detail, by a network connector 38 with a network cable 40. In certain countries, in hand-held power tools 2, there is provided, as shown with dash-dot lines, a ground wire 44 secured to the network connector 38 which, in turn, is connected with a protective conductor 42 of the network cable 40. The protective ground wire 44 forms an electrical contact with a metallic element of the hand-held power tool 2 such as, e.g., the gear unit housing 16, as shown in the drawing. Alternatively, the protective ground wire 44 can be connected with any other or additional element such as, e.g., the percussion mechanism housing 18 or a common housing part of the drive unit 14 and the percussion mechanism 18. The electrical connection of the metallic element with the protective conductor permits to divert current applied to the metallic element, without any damage of the metallic element. In some countries, such protective ground wires are not required.

Figure 2:
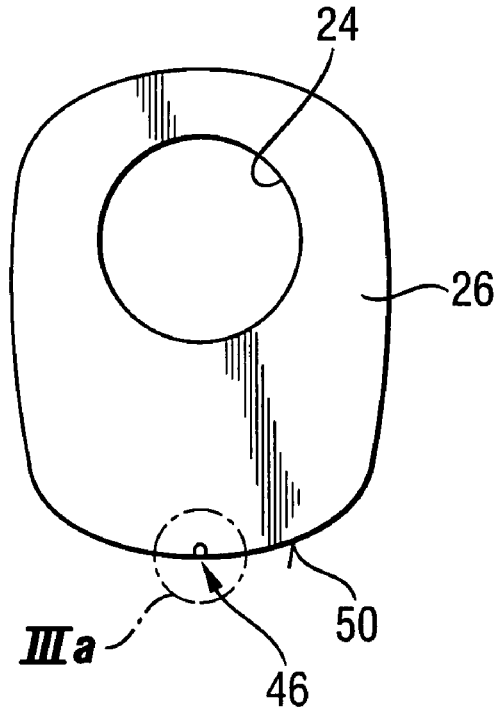
FIG. 2 a plan view of the separation element of the hand-held power tool of FIG. 1.

In order to be able to use the same components for the hand-held power tools 2 independent on the country in which they will be used, there is provided on the separation element 26, as shown in FIGS. 1-2, a limited wire passage region 46 which is closed in its initial condition and, if needed, enables insertion of the protective ground wire 44 in a predetermined position of the separation element 26. In hand-held power tools 2 that do not require any protective ground wire, the wire passage region remains closed.

Thereby, independent from whether use of the protective ground wire is required or note, unnecessary, separate from the air flow L, pressure or temperature balance between the suction region 28 and the pressure region 30 is prevented, whereby favorable flow characteristics and an adequate cooling efficiency can be insured.

Figure 3A:
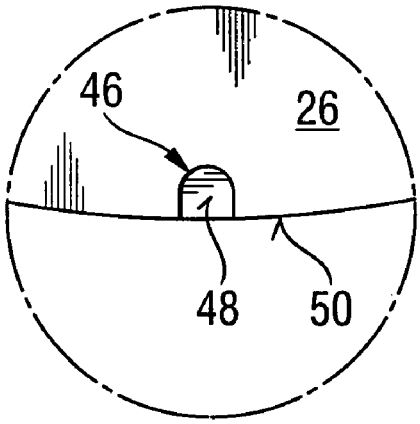
FIG. 3*a* a view, at an increased, in comparison with FIG. 2, scale, of a wire passage region of the separation element in region IIIa in FIG. 2.

As shown in FIG. 3*a*, the separation element 26 has, for an optional opening of the wire passage region 46, opening means in form of a plane embossing 48. The embossing 48 forms a U-shaped limited material weakening of the separation element 26 and that extends up to the edge 50 thereof. The embossing 48 serves as break-through assistance means, whereby the material in the wire passage region 46 can be broken through with e.g., a flat nose pliers, not shown.

Figure 3B:
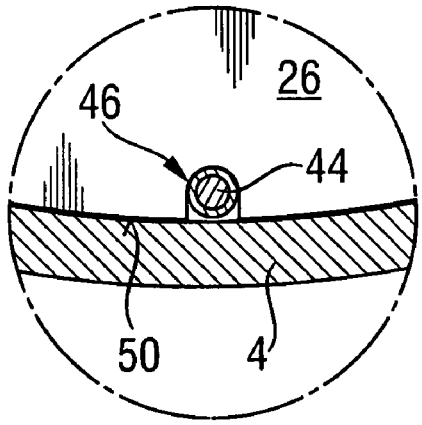
FIG. 3*b* a view of the wire passage region according to FIG. 3*a* but in a condition after the final assembly with an inserted ground wire.

FIG. 3*b* shows a separation element in a mounted condition with an open wire passage region. There, a ground wire 44 is located. As shown in FIG. 3*b*, the size of the open wire passage region 46 corresponds to the cross-section of the protective ground wire.

Figure 4A:
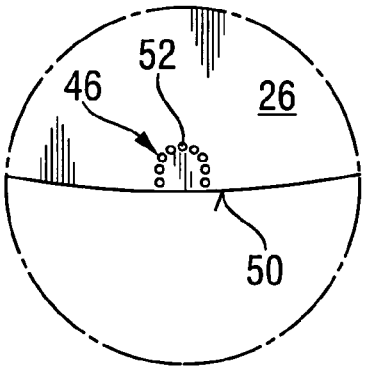
FIG. 4*a* a view of an alternative embodiment of the wire passage region.
Figure 4B:
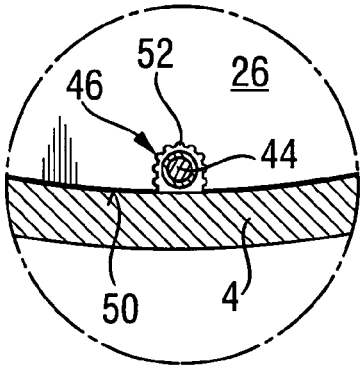
FIG. 4*b* a view of the wire passage region according to FIG. 4*a* but in a condition after the final assembly with an inserted ground wire.

FIGS. 4*a*-4*b* show an alternative embodiment of the wire passage region 4*b*. In the embodiment of FIGS. 4*a*-4*b*, the opening means formed by U-shaped, arranged in row recesses 52 such as through-or blind bores, as shown in FIG. 4*b*. The material in the wire passage region 46 is weakened by the recesses 52 and is broken therethrough. Alternatively, to the shown embodiment, the recesses can be formed as elongate recesses.

Figure 5A:
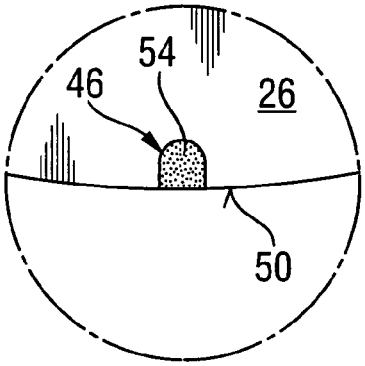
FIG. 5*a* a view of an alternative embodiment of the wire passage region.
Figure 5B:
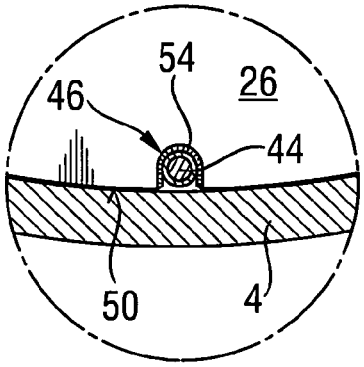
FIG. 5*b* a view of the wire passage region according to FIG. 5*a* but in a condition after the final assembly with an inserted ground wire.

In the embodiment according to FIGS. 5*a* and 5*b*, an elastic diaphragm 54 is provided in the wire passage region 46, closing the same in the initial condition. As shown in FIG. 5*b*, upon insertion of the protective ground wire 44, the diaphragm 54 is pressed sidewise, providing for a particularly good sealing of the wire passage region 46 as a result of action of recovery deformation forces.

Figure 6A:
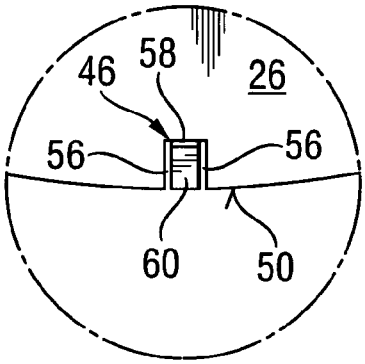
FIG. 6*a* a view of further alternative embodiment of the wire passage region.
Figure 6B:
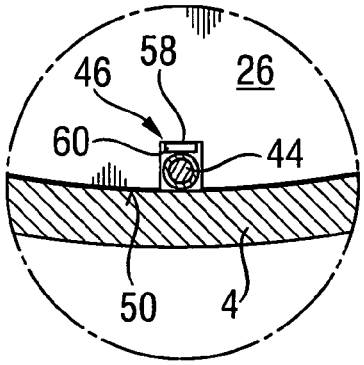
FIG. 6*b* a view of the wire passage region according to FIG. 6*a* but in a condition after the final assembly with an inserted ground wire.

In the embodiment according to FIGS. 6*a*-6*b*, the wire deformation region 46 is formed by two parallel incisions 56 at the edge 50 and a film hinge 58. In this way, the material of the separation element 26 forms a flap 50 in the wire passage region 46. For insertion of the protective ground wire 44, the flap 60 can be elastically or plastically deflected over the film hinge 58, as shown in FIG. 6*b*.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An electrical hand-held power tool (2), comprising a housing (4); a drive (6) located in the housing (4); ventilation means (22) for forming a suction region (28) and a pressure region (30) in the housing (4) which provide for an air flow (L) that serves for cooling at least some parts of the drive (6); and a separation element (26) arranged between the suction region (28) and the pressure region (30) and fixedly secured in the housing (4), the separation element (26) having a predetermined break-through region for forming, upon being broken through, a limited wire passage region (46) between the suction region (28) and the pressure region (30) for passing a wire therethrough.

2. A hand-held power tool according to claim 1, wherein the separation element (26) is formed by air conducting means located in the housing (4), with the wire passage region (46) being formed at an edge (50) of the separation element (26).

3. A hand-held power tool according to claim 1, wherein the break-through region is formed by material weakening.

4. A hand-held power tool according to claim 3, wherein the material weakening has a U-shape delimitation extending to the edge (50) of the separation element (26).

5. An electrical hand-held power tool (2) according to claim 1, wherein the predetermined break-through region is irreversibly deformed upon being broken through.

* * * * *